United States Patent [19]

Joseph et al.

[11] Patent Number: 4,887,132

[45] Date of Patent: Dec. 12, 1989

[54] ELECTROGRAPHIC DEVELOPMENT APPARATUS HAVING A RIBBON BLENDER

[75] Inventors: Brian J. Joseph, Rochester; Thomas K. Hilbert, Spencerport, both of N.Y.

[73] Assignee: Eastman Kodak Company, Rochester, N.Y.

[21] Appl. No.: 597,323

[22] Filed: Apr. 6, 1984

[51] Int. Cl.[4] ..... G03G 15/08

[52] U.S. Cl. ..... 355/253

[58] Field of Search ..... 355/3 DD, 14 D; 366/318-322

[56] References Cited

U.S. PATENT DOCUMENTS

| | | | |
|---|---|---|---|
| 319,311 | 6/1985 | Peters | 366/155 |
| 1,457,848 | 6/1923 | Majonnier | 366/327 |
| 1,861,721 | 6/1932 | Scott | 99/453 |
| 2,504,786 | 4/1950 | Bailey | 222/610 |
| 3,293,117 | 12/1966 | Pennington et al. | 162/236 |
| 3,305,141 | 2/1967 | Wheeler | 222/637 |
| 3,639,051 | 2/1972 | Cherlap et al. | 355/3 DD |
| 3,664,299 | 5/1972 | Shaler et al. | 118/652 |
| 3,675,904 | 7/1972 | Bremmer et al. | 366/320 |
| 3,724,725 | 4/1973 | Stauffer | 222/240 |
| 3,865,081 | 2/1975 | Charland et al. | 118/653 Y |
| 3,877,881 | 4/1975 | Ono | 422/135 |
| 3,881,446 | 5/1975 | Kurita | 118/657 |
| 3,912,388 | 10/1975 | Takahashi et al. | 355/3 DD |
| 3,924,567 | 12/1975 | Koleman et al. | 118/652 |
| 3,943,887 | 3/1976 | Smith | 118/657 |
| 3,995,590 | 12/1976 | Volkers | 118/602 Y |
| 4,030,447 | 6/1977 | Takahaski et al. | 118/658 |
| 4,100,611 | 7/1978 | Jugle | 366/139 |
| 4,101,211 | 7/1978 | Kayson | 355/3 DD |
| 4,163,614 | 8/1979 | Vock | 355/3 DD |
| 4,173,405 | 11/1979 | Swapceinski et al. | 355/3 DD |
| 4,194,465 | 3/1980 | Tsukamoto et al. | 118/658 |
| 4,235,194 | 11/1980 | Wada et al. | 118/657 |
| 4,237,943 | 12/1980 | Ermel et al. | 141/284 |
| 4,286,544 | 9/1981 | Witte | 118/657 |
| 4,301,228 | 11/1981 | Kori et al. | 430/122 |
| 4,344,692 | 8/1982 | Oda | 355/3 DD |
| 4,354,763 | 10/1982 | Koiso et al. | 366/181 |

OTHER PUBLICATIONS

Research Disclosure 22006, p. 12, vol. 220, Aug., 1982.

The Performance of Continuous Mixers for Dry Powders; Powder Technology, Nov. 1975, pp. 289-296, by C. F. Harwood et al.

Which Mixer, Chemical Engineering Progress, Jan. 1957, (vol. 53, No. 1) pp. 25J-32J by J. B. Gray.

Update on Batch-Compounding Equipment-Part II: Low-and Medium-Intensity Batch Mixers, Plastics Compounding, Mar./Apr. '81.

Brochures: Ribbon Blenders by Ross-RB-978, Charles Ross & Son Company.

Day Mixing (Mixing and Size Reduction Equipment) Style B Horizontal Batch Mixers, Sprout-Waldron, bulletin 3460.

*Primary Examiner*—Arthur T. Grimley
*Assistant Examiner*—J. Pendegrass
*Attorney, Agent, or Firm*—Leonard W. Treash

[57] ABSTRACT

An electrographic development apparatus has a sump for receiving developer material including carrier particles and toner particles. A magnetic brush receives development material from the sump and moves the material into a position relative to an electrostatic image carried on an insulating surface so that toner particles can be transferred to the electrostatic image to develop such image. A ribbon blender in the sump mixes the toner and carrier particles of the developer material, circulates developer material axially within the sump, agitates and shears the developer material, promotes tribocharging, and feeds developer out of the sump along a path leading to the magnetic brush.

4 Claims, 4 Drawing Sheets

ELECTROGRAPHIC DEVELOPMENT APPARATUS HAVING A RIBBON BLENDER

BACKGROUND OF THE INVENTION

This invention relates to improvements in electrographic development apparatus wherein developer material is mixed and triboelectrically charged in a sump before delivery to a magnetic brush for development of an electrostatic image. More specifically, the invention relates to an improved development apparatus having a ribbon blender for mixing and tribocharging developer material in a sump.

Electrographic development apparatus are well known in the art. Such apparatus may include a housing in which developer material is located and a magnetic brush that receives such material from the housing and transports it to a position where part of such material can be transferred to an electrostatic image formed on an insulating surface to thereby develop the image. The developer material may comprise a mixture of carrier particles and smaller toner particles. Some of the toner particles are transferred from the mixture to the electrostatic image during development of the image. Thus there is a need to replenish toner particles in used developer material in the housing. In order to replenish toner particles in used developer material, the used developer material can be delivered from the housing to an end sump along with the addition of fresh toner particles. The materials in the end sump are then mixed and agitated in order to thoroughly mix the fresh toner particles with the used developer material and to effect triboelectric charging of the materials. The resulting toner-replenished developer material is then transported from the end sump to the housing by means of augers or other apparatus so that the development material is again available for transfer of toner to a magnetic brush for development of an electrostatic image. An apparatus of this general type is disclosed in commonly assigned U.S. Pat. No. 4,101,211, issued July 18, 1978 in the name of Walter Kayson and entitled MAGNETIC CURTAIN SEAL FOR DEVELOPMENT APPARATUS. Such development apparatus requires relatively high circulation rates in order to transport toner replenished development material from the end sump along the entire length of the housing of the development station. Such high circulation rates increase power requirements for the development apparatus and decrease the developer life.

Recently a new developer material has been developed wherein the carrier particles comprise permanent magnets. The particles in such a material have a tendency to cling to each other to form clumps and, in general, in the absence of an external field, such materials have a tendency to behave somewhat like wet sand due to the magnetic attraction exerted between the particles. Such a material creates special problems in mixing developer material, circulating the material axially along a development station, agitating and shearing the developer to promote tribocharging and then feeding the developer to a magnetic brush. A material of this type is disclosed in the commonly assigned copending U.S. patent application Ser. No. 548,807, filed on Nov. 4, 1983 in the names of E. T. Miskinis et al, and entitled TWO COMPONENT, DRY ELECTROGRAPHIC DEVELOPER COMPOSITIONS CONTAINING HARD MAGNETIC CARRIER PARTICLES AND METHODS FOR USING THE SAME, now U.S. Pat. No. 4,546,060, issued Oct. 8, 1985.

SUMMARY OF THE INVENTION

The present invention eliminates the need for separate end sump mixing and agitating of developer materials as mentioned above, and also provides the required mixing, circulation etc. for a developer material having permanently magnatized carrier particles. The present invention is useful with developer apparatus having a sump for a supply of developer material and a magnetic brush for providing such material to an electrostatic image carried on an insulating surface. The improvement of the invention includes means in the sump for mixing particles of developer material. The mixing means comprises a ribbon blender having a first spiral ribbon for moving such material in one direction and a second spiral ribbon for moving such material in the opposite direction. Means also are provided for feeding developer material from the sump to the magnetic brush.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
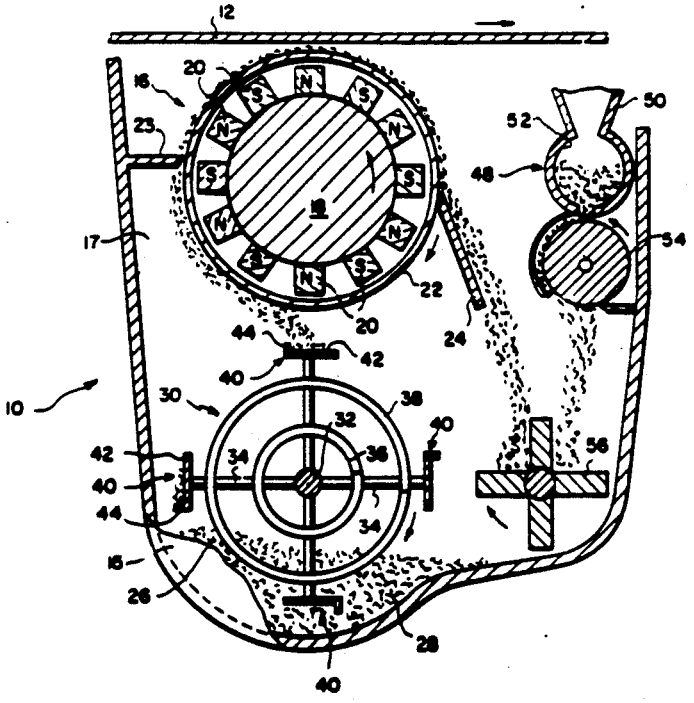
FIG. 1 is an end view of one preferred embodiment of development apparatus of the present invention illustrated relative to an insulating surface of a photoconductor or the like that is adapted to transport an electrostatic image thereon past the development apparatus.

Referring now to FIG. 1 of the drawings, development apparatus of the present invention is generally designated 10 and is adapted to provide a supply of marking particles, such as toner, to an electrostatic image formed on a photoconductor 12 of electrographic apparatus to develop the image. The photoconductor can be in the form of an endless web, or drum, or discrete sheets. As known in the art, the photoconductor is moved along a path leading past the apparatus 10 during operation of the electrographic apparatus. The image developed on the photoconductor can be fused to the photoconductor or can be transferred to a receiver sheet and fused on such sheet as is well known in the electrographic arts.

The development apparatus 10 has an elongate housing 14 with end walls 15 and 17. A magnetic brush 16 located in the upper portion of housing 14 extends substantially the entire length of the housing and is closely adjacent to the path of the photoconductor 12. The magnetic brush preferably comprises a core 18 and a series of permanent magnets 20 concentrically arranged around the core 18. The core and magnets are rotatable in a counter-clockwise direction as viewed in FIG. 1 by a motor (not shown). Magnets 20 are arranged so that the poles at the outer portions thereof are alternately north and south poles as indicated in the drawings. Concentric with the core 18 and magnets 20 is a cylindrical, non-magnetic shell 22 which is driven in a clockwise direction by suitable means (not shown). During rotation of the shell, the magnets 20 serve to hold magnetic developer material against the shell and thus bring such material into contact with the lower or insulating surface of the photoconductor 12 in a conventional manner.

A feed skive 23 has an edge adjacent to the surface of shell 22. Skive 23 limits the thickness of developer material 28 carried to photoconductor 12 by the brush 16. Excess material 28 removed by the skive drops into sump 26. A wiper 24 removes material 28 from shell 22 after such material has been carried past the area of contact with the photoconductor.

The lower portion of housing 14 beneath magnetic brush 16 is recessed to form a sump 26. The sump is adapted to receive a supply of developer material 28. The developer material may comprise a mixture of magnetic carrier particles and toner particles, the developer material may comprise a single component developer. The invention is particularly useful with a developer material comprising hard carrier particles of permanent magnetic material and toner particles as disclosed in the before-mentioned copending, commonly assigned U.S. patent application Ser. No. 548,807.

Figure 2:
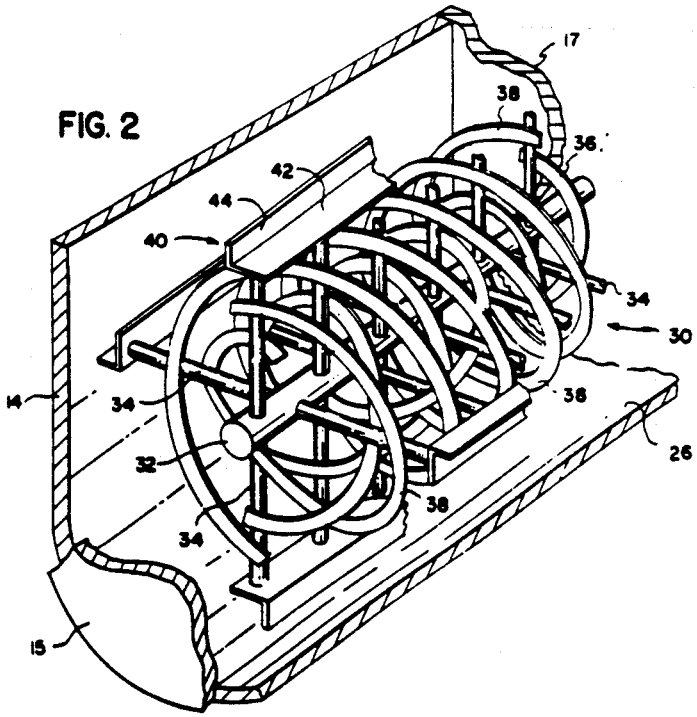
FIG. 2 is a fragmentary perspective view illustrating the ribbon blender and feeder vane assembly of the FIG. 1 apparatus.

Means are provided in the sump 26 for mixing the developer material 28 and for feeding such material from the sump 26 to the magnetic brush 16. As disclosed in FIGS. 1 and 2, the mixing and feeding means comprises a combination ribbon blender and feeder vane assembly generally designated 30. Assembly 30 comprises a shaft 32 that is adapted to be driven in a clockwise direction as viewed in the drawings by a motor (not shown). Shaft 32 can be driven independently, or it can be coupled to the drive for brush 16 or other parts of the apparatus. A plurality of rods 34 project radially outwardly from shaft 32. As shown in FIG. 2, the rods are arranged in pairs with each rod of a pair being approximately 180° from the other rod of the pair and with one pair of rods being offse 90° from the adjacent pair of rods. Also, adjacent pairs of rods are spaced axially along the shaft 32.

An inner ribbon 36 spirals around shaft 32 and extends along the length of the shaft in a helical fashion with the convolusions of the ribbon being substantially equally spaced from the shaft 32. Ribbon 36 is secured to the rods 34 and thus rotates with the shaft 32. The pitch of the ribbon is such that rotation of shaft 32 in a clockwise direction tends to move developer material in sump 26 from the end of the ribbon blender and feeder vane assembly at the left end of FIG. 2 toward the right end thereof. In other words, ribbon 36 moves developer material from wall 15 of the housing toward wall 17 of the housing. Ribbon 36 is symetrically positioned relative to shaft 32 and is dimensioned so that it is about halfway between the shaft 32 and the ends of the rods 34.

A similar but larger helical ribbon 38 spirals around shaft 32 and the inner ribbon 36. The outer ribbon 38 is secured to rods 34 near the outer ends thereof and the pitch of ribbon 38 is opposite to the pitch of ribbon 36. Thus when shaft 32 is rotated in a clockwise direction ribbon 38 tends to move developer material in sump 26 from the right end of the shaft as viewed in FIG. 2 (near wall 17) toward the left end of the shaft (toward wall 15). Thus ribbons 36 and 38 move developer material in opposite directions through the sump during rotation of shaft 32.

During rotation of the shaft 32 the ribbons 36, 38 are effective to thoroughly mix the toner and carrier particles that make up the developer material as well as to circulate the developer material axially along the housing of the development apparatus both in a left-to-right direction and a right-to-left direction. This movement of the developer material agitates and shears the developer material to promote tribocharging thereof. A ribbon blender is especially effective for mixing developer materials having the characteristics of the material disclosed in the before-mentioned co-pending U.S. patent application Ser. No. 548,807.

Assembly 30 further comprises a plurality of feeder vanes 40 located radially outwardly with respect to the outer ribbon 38. In the embodiment illustrated in the drawings four such vanes are provided and are secured to the outer ends of the rods 34. Each vane 40 comprises a generally flat portion 42 that is substantially perpendicular to the rods 34 and a lip portion 44 located at one side edge of the flat portion. Lip 44 is on the trailing edge of the flat portion when the shaft 32 is rotated in a clockwise direction as viewed in the drawings. As a result, movement of the feeder vanes through the developer material in sump 26 results in a quantity of developer material being picked up by each vane, and the material is brought into close engagement with the magnetic brush 16. When the vane reaches the position immediately beneath the magnetic brush (the position shown by the upper vane 40 in FIG. 1), developer material is attracted from the vane toward the magnets in the magnetic brush and thereby transferred from the vane to the rotating shell 22 of the magnetic brush.

As toner from the developer material is transferred from the magnetic brush to the photoconductor 12, it becomes necessary to replenish the toner supply in the developer material. For this purpose, a toner replenishment mechanism generally designated 48 is provided. Mechanism 48 can be of any suitable construction but preferably is one which allows for substantially uniform toner replenishment along the entire length of the sump of the development apparatus. By way of example, the toner replenishment mechanism 48 may be constructed in the manner disclosed in Item No. 22006 on page 12 of Vol. 220 (Aug. 1982 edition), of Research Disclosure, published by Kenneth Mason Publications, Ltd., Homewell, Havant, Hampshire, PO91EF, United Kingdom. Such a mechanism comprises supply hopper 50 through which toner is supplied to a tube 52. A series of openings in the bottom of the tube allows toner to be dispensed throughout the length of the tube. The tube is substantially the same length as sump 26. A toner transport 54 can be located immediately beneath the tube 52 and driven in the direction indicated to dispense toner to the right side of the housing 14 as illustrated in FIG. 1. Transport 54 may be a so-called "paint roller" type of toner transport.

As fresh toner is delivered into housing 14 from mechanism 48, it drops along a line or band extending the length of the development apparatus and generally onto a paddle wheel type conveyor generally designated 56. The paddle wheel conveyor is rotated about its axis in a clockwise direction as indicated by the arrow. In addition, developer material which has been depleted of toner and stripped from the shell 22 by wiper 24 also is delivered into the lower right portion of the housing generally in the area of the paddle wheel 56. Thus developer material depleted of toner and fresh toner arrive in the same general area of the housing and are simultaneously delivered by the paddle wheel 56 into the lower portion of the sump 26 for mixture with other developer material in the sump by the ribbon blender and vane assembly 30.

In operation, magnetic brush 16 and shaft 32 are driven in the directions indicated by the arrows in FIG. 1. Developer material in sump 26 is mixed, circulated axially within the development apparatus and thus triboelectrically charged by the ribbons 36, 38 which constantly move the developer material in two opposite axial directions within the sump. This thorough mixing and moving of the developer material agitates and shears the developer to promote the required tribocharging of the developer material. If desired, shaft 32 can be independently driven before rotation of the brush is started in order to prepare the developer material for use.

Rotation of shaft 32 brings the feeder vanes 40 sequentially through the sump to pick up developer material and feed it to the position shown for the upper vane 40 in FIG. 1 at which point developer material is attracted to the rotating shell 22 of the magnetic brush 16. Movement of the shell and the magnets 20 of the brush transports developer material around the shell in a clockwise direction. As the material reaches the feed skive 23, excess developer material is removed from the brush and returned to the sump 26. Thus a uniform thickness of developer material remains on the brush and is transported into contact with the lower, insulating surface of photoconductor 12 for transfer of toner material to an electrostatic image thereon. In FIG. 1 the photoconductor is shown moving co-current relative to shell 22, but it also could be moved counter-current if desired.

As the magnetic brush continues to rotate the toner depleted portion of the developer material remaining on the brush reaches the wiper 24 and is removed from the brush. The removed developer material drops into the area of the paddle wheel 56 along with fresh toner from the mechanism 48. The paddle wheel 56 returns such materials to the sump 26 for thorough mixing with the developer material remaining in the sump.

Figure 3:
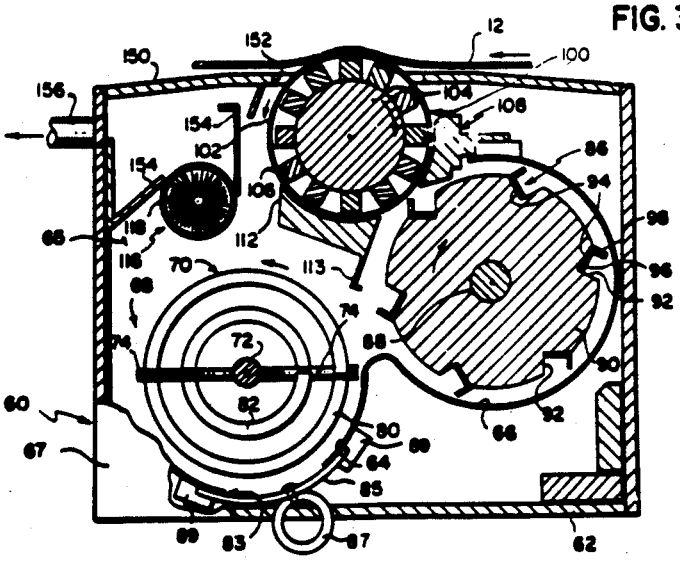
FIG. 3 is an end view, similar to FIG. 1, but illustrating another preferred embodiment of the development apparatus of the invention.

Another preferred embodiment of the invention is illustrated in FIGS. 3–5 and 8 of the drawings. Referring initially to FIG. 3, the development apparatus generally designated 60 includes an elongate housing 62 having a first generally cylindrical recess 64 along one longitudinal side edge portion of the housing and a second generally cylindrical recess 66 adjacent to recess 64 and located slightly above the recess 64. Recess 64 and adjacent areas of the housing 62 define a sump 68 for developer material. Sump 68 extends substantially the full length of the housing 62 and eliminates the need for a separate end sump for mixing developer as required in some prior apparatus. Recesses 64, 66 extend substantially the entire distance from a back wall 65 to a front wall 67 of the housing.

Figures 4, 8:
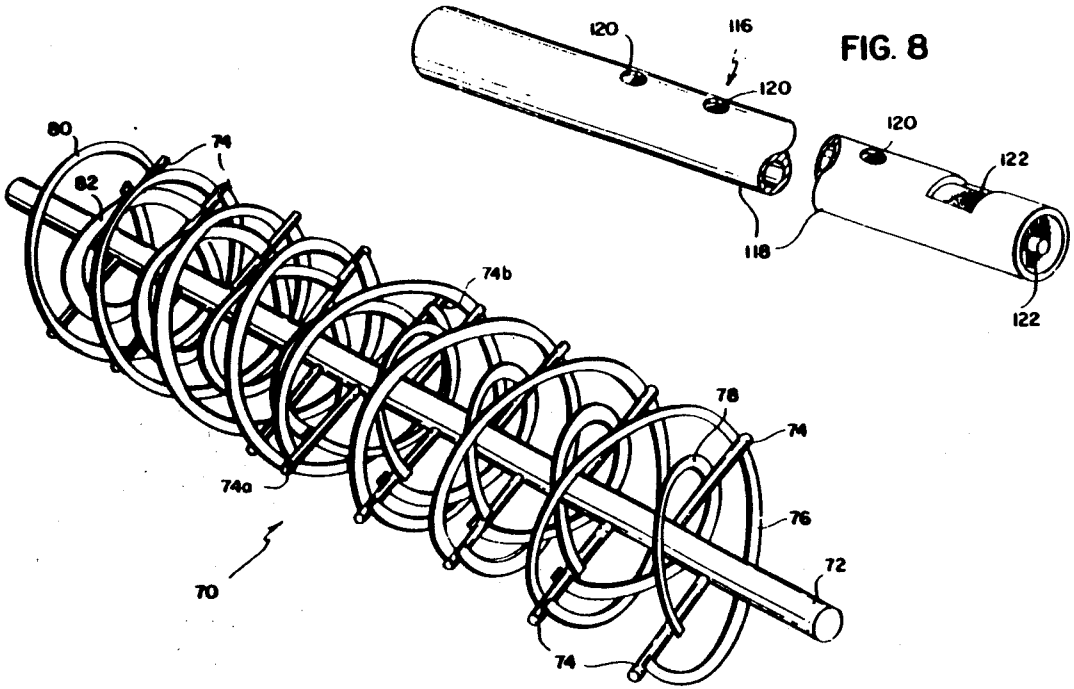
FIG. 4 is a perspective view of the ribbon blender illustrated in FIG. 3.
FIG. 8 is a perspective view of the toner replenishment mechanism used with the developer apparatus shown in FIG. 3.

Referring now to FIGS. 3 and 4, a ribbon blender generally designated 70 is positioned within the sump 68 with the lower portion thereof being adjacent the cylindrical wall 64 of the housing. Blender 70 comprises a shaft 72 mounted for rotation about its axis in a generally counterclockwise direction as viewed in FIG. 3. A plurality of rods 74 project radially outwardly from the shaft 72 with adjacent rods being offset axially along the shaft 72 and projecting in substantially diametrically opposite directions. Two additional rods 74*a* and 74*b* at approximately the center of the shaft are diametrically opposed to each other. An outer spiral ribbon 76 extends in a helical manner along approximately one half of the shaft 72. Ribbon 76 can be made in sections and scured to rod 74*a* and the rods 74 on one end of the shaft. Each portion of ribbon 76 is substantially equally spaced from the shaft 72. An inner ribbon 78 also is secured to rods 74 and extends along the same end portion of shaft 72 and for substantially the same distance as the ribbon 76. The inner ribbon 78 is smaller in diameter than the outer ribbon 76, and the inner ribbon also has a pitch that is opposite to the pitch of the ribbon 76. Ribbon 78 is secured to rods 74 and rod 74*a* . Thus upon rotation of shaft 72 in one direction, the outer ribbon tends to move the developer material in one direction and the inner ribbon 78 tends to move the developer material in the opposite direction.

Secured to rod 74*b* and the rods 74 at the other end portion of shaft 72 is another outer ribbon 80 and another inner ribbon 82. Ribbons 80, 82 extend from adjacent the second end of the shaft 72 to a position near the center of the shaft and adjacent the ends of the ribbons 76, 78. Ribbon 80 is substantially the same as ribbon 76 but is positioned around shaft 72 so that the pitch of ribbon 80 is opposite in direction to the pitch of ribbons 76. Similarly, ribbon 82 is similar to ribbon 78 but is positioned around the shaft 72 so that its pitch is opposite in direction to the ribbon 78. Also, the pitch of ribbon 80 is opposite in direction to the pitch of ribbon 82, just as the pitch of ribbon 76 is opposite to that of ribbon 78. Thus when shaft 72 is rotated in one direction, for example in a clockwise direction as viewed from the right end of the shaft in FIG. 4, the outer ribbons 76 and 80 tend to move developer material along a generally cylindrical path toward the center of blender 70. Simultaneously, inner ribbons 78 and 82 tend to move developer material in a generally cylindrical path from the center of blender 70 toward the ends thereof. Shaft 72 could, of course, be rotated in the opposite direction in which case the outer ribbons would tend to move developer material toward the ends of the shaft and the inner ribbons would tend to move developer material toward the center of the shaft.

As noted previously, the ribbons at one end portion of shaft 72 are secured to center rod 74*a* while the ribbons at the other end portion of the shaft are secured to center rod 74*b* . This arrangement of the ribbons encourages some end-to-end mixing of developer material because some of the material moved to the center of the shaft by a ribbon at one end of the shaft will be picked up and circulated by a ribbon at the other end of the shaft.

As well known in the art, used developer material is periodically removed due to normal deterioration of the material and replaced with new developer material. To facilitate the removal of developer material from sump 68, an elongate opening 83 can be provided in the bottom of wall 64 beneath the center portion of blender 70. A cover 85 with a handle 87 normally closes opening 83. The cover is slideable axially in supports 89 so that the cover can be moved to a position wherein the developer material falls through the opening into a container (not shown). The removal of developer material is facilitated by operation of development apparatus 60. More specifically, the blender 70 has outer ribbons 76, 80 that move such material toward the center of the blender where opening 83 is located. By operating the blender after cover 85 has been moved to uncover opening 83. the material is driven to the opening and falls into a container beneath the opening. Developer material in recess 66 and in other ports of the apparatus will be returned to sump 68 for removal by operation of a feeding means 86 and a wiper 112 as described later.

In the embodiment of the invention illustrated in FIGS. 3-8, developer material in sump 68 is not fed from the sump to the magnetic brush by vanes as shown at 40 in FIG. 1 but, instead, is fed from the sump to a magnetic brush by a feeding means that is separate from the ribbon blender 70. The feeding means generally designated 86 in FIGS. 3 and 5 comprises a shaft 88 that is adapted to be rotated about its axis by suitable drive means (not shown). A pair of generally circular end plates 90 are secured to end portions of the shaft and are located n planes generally perpendicular to the axis of the shaft. The end plates have a series of notches 92 equally spaced around the periphery of the plates. A plurality of vanes 94 are secured at their ends to the end plates 90. The vanes 94 each have a base portion 96 secured to the end plates 90 in one of the notches 92 and a projecting flange portion 98 that projects from the base portion and is substantially perpendicular thereto. Flange portions 98 extend beyond the periphery of the end plates 90 as best illustrated in FIG. 3. The feeding means 86 is mounted in housing 62 so that shaft 88 is substantially parallel to shaft 72 of the blender. Also, the path of travel of flanges portions 98 of the vanes is adjacent wall 66 of the housing and the outer ribbons of blender 70.

Rotation of shaft 88 in a clockwise direction as viewed in FIG. 3 brings each of the vanes 94 sequentially through the lower portion of the housing 66 and the portion of the sump 68 adjacent to the ribbon blender 70. The level of developer material in sump 68 is sufficiently high so that vanes 94 pick up developer material as they travel through the housing 66 and sump 68 for delivery to the magnetic brush as described later. Any remaining developer material drops from the vanes as they move through the right half of their path of travel as viewed in FIG. 3.

Developer material is delivered by the feeding means 86 to a magnetic brush generally designated 100 in FIG. 3. The magnetic brush 100 can be the same or similar to the brush 16 illustrated in FIG. 1. More specifically, brush 100 comprises an outer shell 102 that is rotated in a counterclockwise direction and an inner core 104 that is rotated in the opposite direction, i.e., a clockwise direction. Core 104 carries a plurality of permanent magnets 106, such magnets typically comprising an even number of magnets of alternate polarity that are affixed to the core to produce an alternating magnetic field around the perimeter of the core and shell 102. An arcuate segment of the shell is always closely adjacent feeding means 86. As a result, developer material delivered by feeding means 86 is transferred from the vanes 94 as the vanes pass near the magnetic brush and are transported by the shell 102 in a counterclockwise direction about the core 104.

A skive 108 is located adjacent shell 102 and between the feeding means 86 and the photoconductor 12. Skive 108 limits the thickness of developer material carried by the magnetic brush to the photoconductor. As known in the art, the photoconductor 12 can be pressed into engagement with the magnetic brush if desired.

Carrier particles and those particles of toner not transferred from the magnetic brush to the photoconductor 12 are removed from the magnetic brush by a wiper 112 positioned between the photoconductor and the ribbon blender 70. More specifically, the wiper 112 is located so that material removed from the magnetic brush by the wiper drops into the sump 68 where it can be mixed by the ribbon blender with developer material remaining in the sump.

Developer material removed from the brush by wiper 112 may be attracted to the lower part of the wiper assembly by magnets 106 and even have a tendency to return th shell 102. Return of the material to the shell is prevented by a flow diverter 113 that projects downwardly away from the shell. The lower end of the diverter is far enough away from the magnets so that any material on the lower surface of the wiper will fall into the sump before it can travel past the diverter. The diverter also prevents feed of developer material directly from the blender to the wiper assembly and then to the shell 102.

One function of the wiper is to remove developer and plated-out toner from the magnetic brush. Plated-out toner refers to toner that migrates and clings to the magentic brush shell 102 during operation. Such plated-out toner must be removed because it tends to insulate the shell. As known in the art, an electrical bias is applied to the development apparatus. Thus if the shell becomes insulated by plated-out toner, it can alter the development process.

Because toner is transferred to the photoconductor 12, it is necessary to periodically replenish the supply of toner in the developer apparatus. The depletion of toner from the developer material and the need for replenishment can be determined by conventional toner monitoring apparatus (not shown). One form of toner replenishment mechanism suitable for use with the developer apparatus 60 is generally designated 116 in FIGS. 3 and 8. Replenishment mechanism 116 comprises an elongate feed tube 118 that extends along a substantial portion of the housing 62 just above the sump 68 and the ribbon blender 70. Tube 118 has a plurality of spaced openings 120. In FIG. 8 the tube has been rotated so the openings face upwardly; however, when the tube is mounted in housing 62, the openings are located at the bottom of the tube and face the sump 68.

Fresh toner is fed into one end of the tube 118 and can be transported along the tube by a helical fiber feed brush 122 which is partly visible at the right end of the tube in FIG. 8. Rotation of brush 122 distributes the toner along the tube and allows it to drop through each of the openings 120 into the sump. Rotation of the tube can be controlled in response to toner monitor apparatus as previously mentioned. While this particular type of toner replenishment mechanism is illustrated in FIGS. 3 and 8, it will be understood that other types can be utilized, including the toner replenishment mechanism described in connection with FIG. 1.

Figures 5, 6, 7:
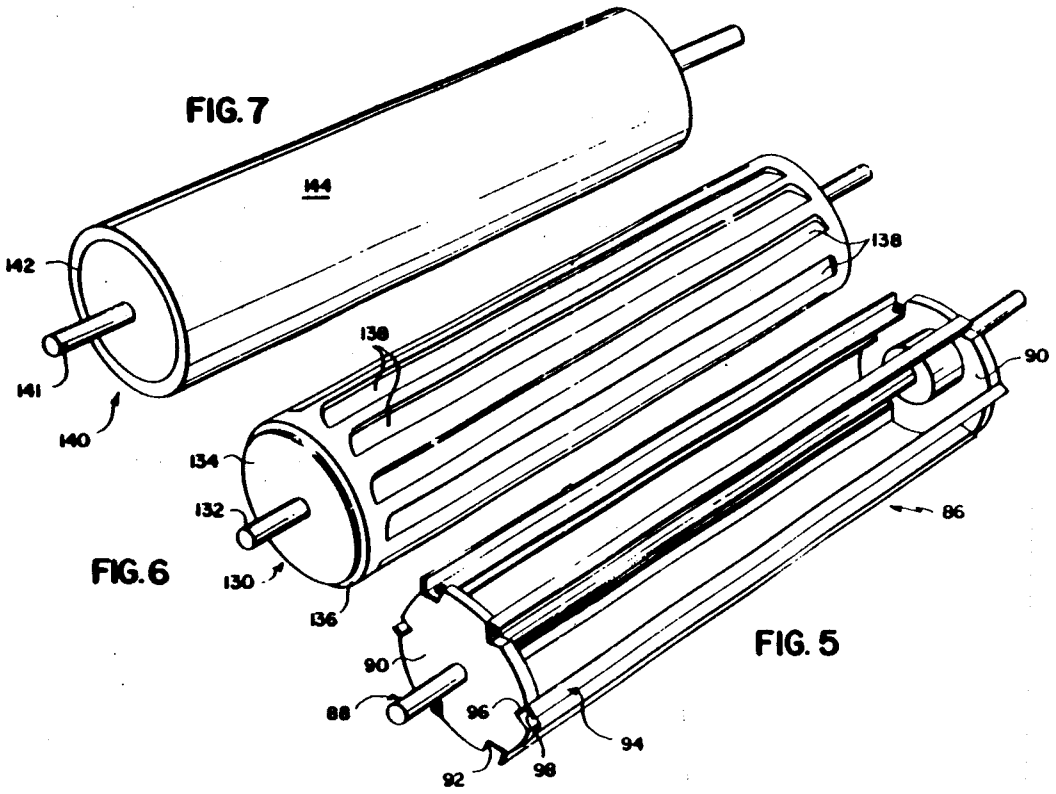
FIG. 5 is a perspective view of the feed mechanism for developer material illustrated in FIG. 3.
FIGS. 6 and 7 are perspective views illustrating other preferred embodiments of the feed mechanism.

FIG. 3 shows the feeding means 86 of FIG. 5 used for transporting developer material to the magnetic brush. Other embodiments of feeding means can also be used for this purpose. Two such additional embodiments are illustrated in FIGS. 6 and 7 of the drawings. In FIG. 6 a feeding means 130 comprises a shaft 132 on which a pair of end plates 134 are mounted, only one such plate being illustrated in FIG. 6. The plates 134 support a generally cylindrical roller 136 having a plurality of circumferentially spaced, elongate grooves 138 therein. In use, shaft 132 is mounted in the same position illustrated for shaft 88 in FIG. 3. As the shaft is rotated, roller 136 is driven through the housing recess 66 adjacent to the ribbon blender 70. As this occurs, developer material is picked up by the grooves 138 in the roller 136 and transported into close proximity to the magnetic brush 100. At that time, developer material is attracted by the magnets 106 to the shell 102 of the magnetic brush.

In the embodiment of the feeding means illustrated in FIG. 7, a shaft 140 and a pair of end plates 142 mounted on the shaft support a magnetic feed roller 144 having a substantially smooth cylindrical outer surface. Within the roller 144 are arranged a plurality of magnets (not shown) that may be similar to the arrangement of magnets shown at 106 for the magnetic brush 100. For this application, the magnets are stationary, and the outer shell rotates to bring developer to the magnetic brush. Thus the magnetic feed roller shown in FIG. 7 will pick up developer material from sump 68 and transport it into close proximity to the magnetic brush 100. Magnetic brush 100 has a magnetic force or attraction which is greater than the magnetic force of the feeding means and, accordingly, the developer material will transfer from the feeding means to the magnetic brush.

Preferably, the development apparatus is provided with means to avoid or reduce contamination of a copier/duplicator by developer material. One way contamination can be reduced is for housing 62 to have a cover 150 with a slot 152 through which shell 102 projects. Thus the housing and cover substantially enclose the development apparatus. Also, the interior of the housing can be provided with baffles 154 which limit movement of airborne particles within the housing. Other baffles 154 can be provided as needed within the housing. In addition, a conduit 156 can be connected to housing 62 and to a vacuum system (not shown) to collect airborne particles that might otherwise escape from the housing to other portions of the copier/duplicator.

In operation of the apparatus shown in FIGS. 3–8, a supply of developer material comprising particles of carrier and toner are placed in the sump 68 and the ribbon blender 70 is operated to thoroughly mix the particles together and to provide the required triboelectric charging of the developer material. This initial operation of the blender may take place independent of operation of other portions of the development apparatus or may occur each time and only when developer material is to be provided to the photoconductor 12. In either event, the mixed and triboelectrically charged developer material is picked up by the feeding means comprising either the feeding means 86, 130 or 140. The feeding means is effective to transport portions of the developer material and bring such material into close proximity to the magnetic brush 100. The magnetic brush attracts the developer material to the rotating shell 102. Any excess developer material on the shell is removed by the skive 108. The developer material thus is brought into contact with the lower or insulating surface of the photoconductor 12 so that toner particles can be transferred to a charged electrostatic image on the photoconductor.

Further rotation of shell 102 brings the remaining developer material to the wiper 112 which is effective to remove such material from the magnetic brush and return it to the sump 68. As required, additional toner is provided to the sump through the replenishment mechanism 116. The new toner and developer material remaining in sump 68 are thoroughly mixed together by the ribbon blender 70 as explained hereinbefore.

The developer apparatus 60 of FIGS. 3–8 is different from the previously described apparatus 10 in several important respects. the apparatus 60 separates the mixing and feeding mechanisms with mixing of the developer material being achieved by the ribbon blender 70 and transporting of such material being by a separate feeding apparatus. In this regard, it should be noted that over a period of time developer material may lose its charge. Developer with low charge may dust considerably when it is transported over the magnetic brush. Because the mixing and feeding steps are separated, the initial step of mixing and triboelectrically charging of the developer material can be accomplished as a start-up function of the apparatus and without having to transport developer over the magnetic brush 100. Such insures proper developer charge prior to transport of developer material to the magnetic brush.

Another advantage achieved by both disclosed embodiments of the invention is that the ribbon blender mixing chamber in the housing also serves as the developer supply sump. The capacity of the sump thus is a function of the ribbon blender geometry. Therefor, the larger the ribbon blender diameter and length, the larger the sump capacity. By providing for a sump capable of holding a large developer supply, a longer time interval can occur between intervals when developer material must be changed. A large developer supply also reduces the toner concentration sensitivity due to toner removal by transfer to the photoconductor 12. In other words, removal of a given quantity of toner particles from a large supply of developer material does not have as much effect on the toner concentration in the developer supply as the removal of the same quantity of toner from a smaller supply of developer material.

In both embodiments, the developer sump preferably runs along substantially the entire length of the developer apparatus as opposed to relatively small end sumps used with some prior apparatus. Also, the ribbon blender, feeding means, magnetic brush and toner replenishment mechanism of each embodiment extend substantially the full length of the housing of the development apparatus. Thus it is relatively easy to change the length of the developer apparatus by simply changing the length of the various components. Developer flow rate requirements do not limit the length of the developer apparatus of the present invention even though such reqirements may limit the length of stations where augers are used to transport developer to and from an end sump.

The use of ribbon blenders is known in the mixing industry and has been used, for example, when mixing cohesive-type materials. The use of a ribbon blender in developer apparatus as described herein has been found to be particularly desireable when the apparatus receives developer materials as described in the beforementioned co-pending commonly assigned U.S. patent application Ser. No. 548,807. Ribbon blenders provide a gentle mixing action with plenty of interlayer shearing and ample opportunity for point-to-point contact of toner and carrier particles. These characteristics encourage tribocharging and thorough mixing of developer material with minimum wear of the developer material.

The invention has been described in detail with particular reference to preferred embodiments thereof, but it will be understood that variations and modifications can be effected within the spirit and the scope of the invention as described hereinabove and as defined in the apended claims.

We claim:

1. In development apparatus having a sump for a supply of developer material comprising particles and a magnetic brush for providing such material to an electrostatic image carried on an insulating surface, the improvement comprising:

means in the sump for mixing particles of developer material, said mixing means comprising a ribbon blender having a first shaft rotatable about its axis, and the blender having a first spiral ribbon for moving such material in one direction and a second spiral ribbon for moving such material in the opposite direction, said first and second ribbons being spiraled about said shaft and supported from said shaft for rotation therewith; and means for feeding developer material from the sump to the magnetic brush comprising (a) a second shaft rotatable about its axis, and (b) a plurality of vanes supported by said second shaft in spaced relation to the second shaft, the vanes being located with respect to the ribbon blender and the magnetic brush to pick up developer material mixed by the ribbon blender and deliver such material to the magnetic brush.

2. In development apparatus having a sump for a supply of developer material comprising particles and a magnetic brush for providing such material to an electrostatic image carried on an insulating surface, the improvement comprising:

means in the sump for mixing particles of developer material, said mixing means comprising a ribbon blender having a shaft rotatable about its axis, and the blender having a first spiral ribbon for moving such material in one direction and a second spiral ribbon for moving such material in the opposite direction, said first and second ribbons being spiraled about said shaft and supported from said shaft for rotation therewith; and means for feeding developer material from the sump to the magnetic brush comprising an elongate roller rotatable about an axis, the roller having an outer surface with a plurality of grooves in such surface, the roller being located with respect to the ribbon blender and the magnetic brush to pick up developer material mixed by the ribbon blender and deliver such material to the magnetic brush.

3. In development apparatus having a sump for a supply of developer material comprising particles and a magnetic brush for providing such material to an electrostatic image carried on an insulating surface, the improvement comprising:

means in the sump for mixing particles of developer material, said mixing means comprising a ribbon blender having a shaft rotatable about its axis, and the blender having a first spiral ribbon for moving such material in one direction and a second spiral ribbon for moving such material in the opposite direction, said first and second ribbons being spiraled about said shaft and supported from said shaft for rotation therewith; and means for feeding developer material from the sump to the magnetic brush comprising a generally cylindrical magnetic feed roller rotatable about an axis, the magnetic feed roller being located with respect to the ribbon blender and the magnetic brush to magnetically attract developer material mixed by the ribbon blender and deliver such material to the magnetic brush.

4. In development apparatus having an elongate housing and an elongate magnetic brush supported in the housing, the brush being adapted to provide a mixture of developer material to an electrostatic image carried on an insulating surface, the improvement comprising:

means in the housing defining an elongate sump for a supply of developer material, the sump being beneath the magnetic brush and substantially the same length as the magnetic brush;

a ribbon blender positioned in the sump and extending substantially the entire length of the sump, the blender comprising a shaft rotatable about its axis, the blender having first and second ribbons extending along the sump, each ribbon being substantially helical and having an axis, means mounting the ribbons on the shaft for rotation with the shaft, the first ribbon being smaller in size than the second ribbon and being located between the shaft and the second ribbon, and the pitch of the first ribbon being opposite to the pitch of the second ribbon, the blender having means for rotating the ribbons about their axes so that the first ribbon is effective to move developer material in the sump in a first direction and the second ribbon is effective to move developer material in the sump in a second direction opposite to the first direction, and the blender further comprising a third ribbon and a fourth ribbon, means mounting the third and fourth ribbons on the shaft for rotation with the shaft, the first and second ribbons being at one end portion of the shaft and the third and fourth ribbons being at the other end portion of the shaft, the third ribbon being smaller in size than the fourth ribbon and being located between the shaft and the fourth ribbon, and the pitch of the third ribbon being opposite to the pitch of the first ribbon and the fourth ribbon; and feeding means for picking up developer material in the sump and delivering such material to the magnetic brush.

* * * * *